US006036128A

United States Patent [19]

Cramer

[11] Patent Number: 6,036,128

[45] Date of Patent: Mar. 14, 2000

[54] TIRE SHREDDING MACHINE AND METHOD OF USING THE SAME

[75] Inventor: Neal Cramer, Southampton, N.J.

[73] Assignee: Common Ground Recycling, Inc., Southampton, N.J.

[21] Appl. No.: 09/313,219

[22] Filed: May 17, 1999

[51] Int. Cl.[7] ..... B02C 19/12; B02C 23/02

[52] U.S. Cl. ..... 241/185.5; 241/277; 241/280; 241/DIG. 31

[58] Field of Search ..... 241/185.5, 277, 241/280, DIG. 31, 186.2

[56] References Cited

U.S. PATENT DOCUMENTS

| | | | |
|---|---|---|---|
| 3,364,526 | 1/1968 | Varady et al. | 19/82 |
| 3,721,392 | 3/1973 | Burwell | 241/301 |
| 4,015,782 | 4/1977 | Granite | 241/62 |
| 4,613,087 | 9/1986 | Snyder | 241/111 |
| 4,925,113 | 5/1990 | Wissman et al. | 241/101.4 |
| 4,927,088 | 5/1990 | Brewer | 241/223 |
| 5,024,386 | 6/1991 | Morris | 241/3 |
| 5,375,775 | 12/1994 | Keller et al. | 241/19 |
| 5,785,263 | 7/1998 | Wu et al. | 241/79.1 |

*Primary Examiner*—John M. Husar
*Attorney, Agent, or Firm*—Norman E. Lehrer

[57] ABSTRACT

A tire shredding machine which does not require the massive amount of machinery required for existing tire shredders and which is safe and simple to use is disclosed. The tire shredding machine of the present invention essentially includes a housing with a safety hood, several wheels, and guide elements or wings. In order to shred a tire, the tire is cut in half and each half is fed into the machine one at a time. The safety hood remains in an open position until the tire is fed into the machine. Once the tire is in the machine, the hood is placed into a closed position, a switch is activated, and the wheels pull the half of the tire into the machine. The tire contacts the guide elements which, in turn, spread out or flatten the tire so that the tire may be fed into a grinder which shreds the tire.

4 Claims, 7 Drawing Sheets

4
3
10
5
16b
31
13
14
16a
34
30
50
32
18a
15a
12
18b
36a
36b
20a
36c
36d
22a
20b
5
3
38
40a
4

52
34
16a
14
13
15b
16b
50
22b
18a
18b
36a
36b
36c
36d
20a
20b
40a
38

TIRE SHREDDING MACHINE AND METHOD OF USING THE SAME

BACKGROUND OF THE INVENTION

The present invention is directed toward a system for shredding tires, and more particularly, toward a machine into which only half of a tire is fed and spread out so that a grinder may shred the tire easily and safely.

Disposing of used tires in an effective, economical, and environmentally safe way is a concern to many people and industries. One way to dispose of such tires is to shred them. Shredding tires, however, is a difficult task. One reason for the difficulty is that the tires themselves are extremely flexible, tough, and difficult to handle, especially if the tires are large.

Shredding machines have been known and used in the past but most of these machines are extremely large, thereby requiring a large amount of space and power to operate. They are, therefore, not truly portable and the tires must be brought to the machine wherever it is located. Also, the cutters on these machines often wear out quickly or frequently break teeth due to the flexibility and abrasiveness of the tires. Other machines require heavy equipment. Furthermore, some of these machines require a great deal of manual labor in cutting the tires before they can be shredded. Finally, these machines often do not have adequate safety and protective features for the user. As a result, injury to the user could occur.

A tire shredding device is shown in U.S. Pat. No. 5,024,386 to Morris. Morris discloses a tire converting apparatus which shreds tires into small pieces by first cutting a tire in half or in smaller pieces and then feeding each of these pieces into a shredder. The Morris machine is large and cumbersome and requires a large amount of power to operate. Because of its size and power requirements, It obviously can not be made to be truly portable. A further disadvantage of the Morris machine is that it may cause injury to the user because of the manner in which the tires are introduced into the machine.

There is, therefore, a need for a tire shredding machine that is more compact so that it can be made to be portable yet efficient and safe to operate.

SUMMARY OF THE INVENTION

The present invention is designed to overcome the deficiencies of the prior art discussed above. It is an object of the present invention to provide a tire shredding machine which is compact, safe, and easy to use.

It is another object of the present invention to provide a tire shredding machine which does not require a large amount of power and manual labor to operate and which can be made portable so that it can be brought to locations where tires may be stockpiled or to the used tire generator. By shredding on site at the tire generator, the need to create stockpiles of tires is eliminated.

In accordance with the illustrative embodiments demonstrating features and advantages of the present invention, there is provided a tire shredding machine which essentially includes a housing with a safety hood, several wheels, and guide elements or wings. In order to shred a tire, the tire is cut in half and each half is fed into the machine one at a time. The safety hood remains in an open position until the tire is placed into the machine. Once the tire is in the machine, the hood is moved into a closed position, a switch is activated, and the wheels pull the half of the tire into the machine. The tire contacts the guiding elements which, in turn, splays or spreads out the side walls of the tire as it is engaged by flattening rollers which holds the same into a flattened belt shape so that it may be fed into a grinder which shreds the tire.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
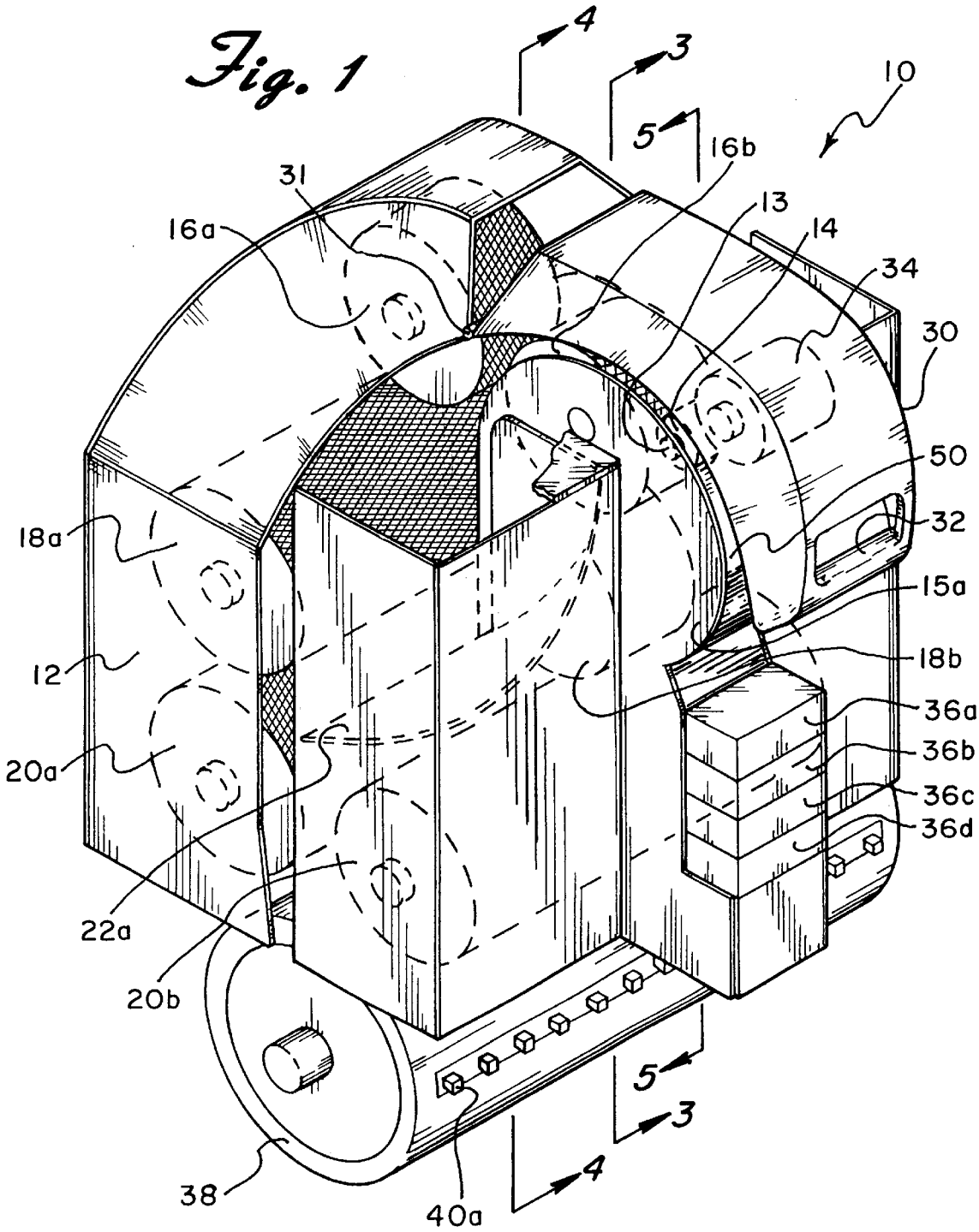
FIG. 1 is a perspective view of the tire shredding machine according to the present invention with various covers and non-functional parts removed for clarity of illustration.
Figure 2:
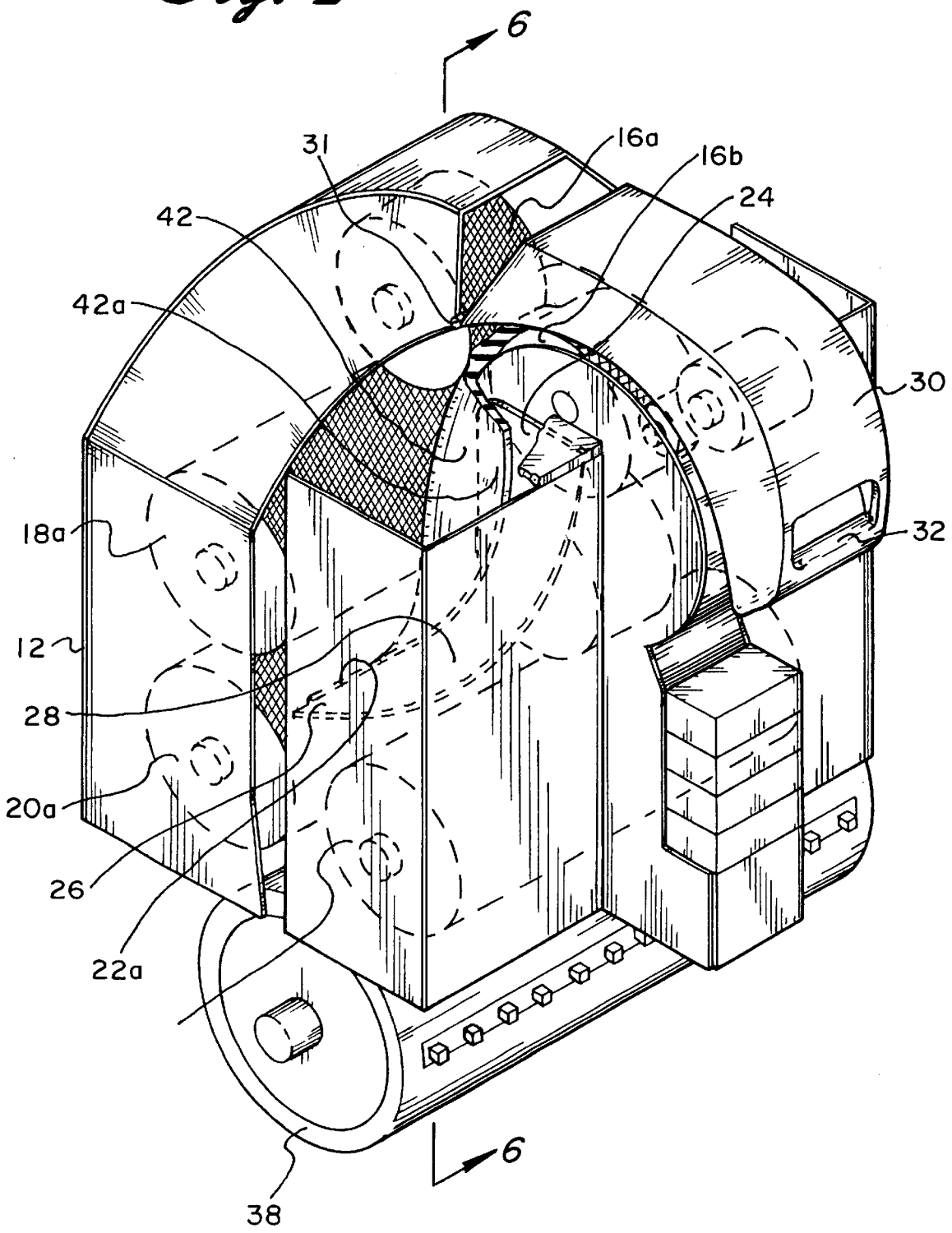
FIG. 2 is a perspective view of the present invention similar to FIG. 1 and showing a portion of a tire within the machine.

Referring now to the drawings in detail wherein like reference numerals have been used throughout the various figures to designate like elements, there is shown in the figures a tire shredding system constructed in accordance with the principles of the present invention and designated generally as 10.

The tire shredding machine 10 essentially includes a housing 12 having an inlet and an outlet. (See FIG. 3.) The housing 12 includes a first intake pilot wheel or roller 14 mounted on an axle 13 between side walls 15*a* and 15*b*. The tire shredding machine 10 further includes a first set of grabber wheels 16*a* and 16*b*, a second set of grabber wheels 18*a* and 18*b*, and a set of flattening rollers 20*a* and 20*b* mounted within the housing 12. All of the wheels or rollers are preferably knurled on their circumferential outer surfaces in order to facilitate gripping a tire as it passes between the wheels. Located adjacent wheels 16*b* and 18*b* and on either side thereof are guiding means or wings 22*a* and 22*b*. The wings 22*a* and 22*b* are curved with each wing, using wing 22*a* as an example, having a top portion or wall 24, a bottom portion or wall 26, and a cam surface 28 where the top portion 24 is narrow and eventually widens near the bottom portion 26.

The housing 12 also has a safety hood 30 located adjacent the inlet which is hinged at 31 to the main part of the housing 12 for pivotal movement relative thereto. The safety hood 30 has a handle 32 and a second intake wheel or roller 34 located within the hood 30. (See FIG. 3.) The safety hood 30 has an open or inoperative position, seen in FIG. 3, and a closed or operative position, seen in FIG. 4. Wheel 34 within the safety hood 30 is arranged so as to be adjacent roller 14 and cooperate therewith when the safety hood is in its operative position. Preferably, the pilot wheel 14 and wheels 16*b*, 18*b*, and 20*b* are idle wheels while wheels 16*a*, 18*a*, 20*a*, and 34 are all driven by a motor (not shown). The tire shredding machine 10 also includes a set of steps or blocks 36*a*–36*d* located beneath the pilot wheel 14 adjacent the inlet. As will be apparent, none or any number of these blocks may be used depending on the size of the tire that is to be shredded by the machine.

Located beneath the housing 12 and adjacent the outlet is a grinder wheel 38 with blades 40*a*–40*j*, for example. It should be realized, however, that the number, size, and shape of the blades may vary depending upon the type of tire being shredded and the size of the shredded pieces desired. The grinder wheel 38 may be driven by the same motor which drives the rollers or wheels of rest of the shredding machine 10. Also, the grinder wheel 38 may be mounted as part of the housing 12 or separately from the rest of the housing 12. However, the grinder wheel 38 must be located directly below and very near the housing 12 so that the tires exiting the machine are still in their flattened state when the blades 40*a*–40*j* of the grinder wheel 38 contact the same. This procedure will be described in more detail below. The grinder wheel 38 may rotate in a clockwise or counterclockwise direction with the blades 40*a*–40*j* being oriented accordingly.

Figure 11:
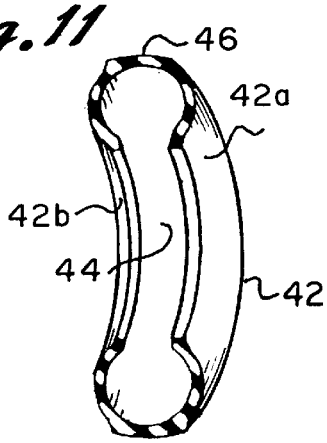
FIG. 11 is a perspective view of a half of a tire before being placed into the shredding machine of the present invention.

In order to use the machine, a tire 42 is first cut in half across a diameter thereof as seen in FIG. 11. It should be realized, however, that depending upon the size of the tire, the tire may be cut into a segment which is less than half. In any event, it is not necessary to first debead the tire segment in order to shred the same in the present shredding machine.

Figure 6:
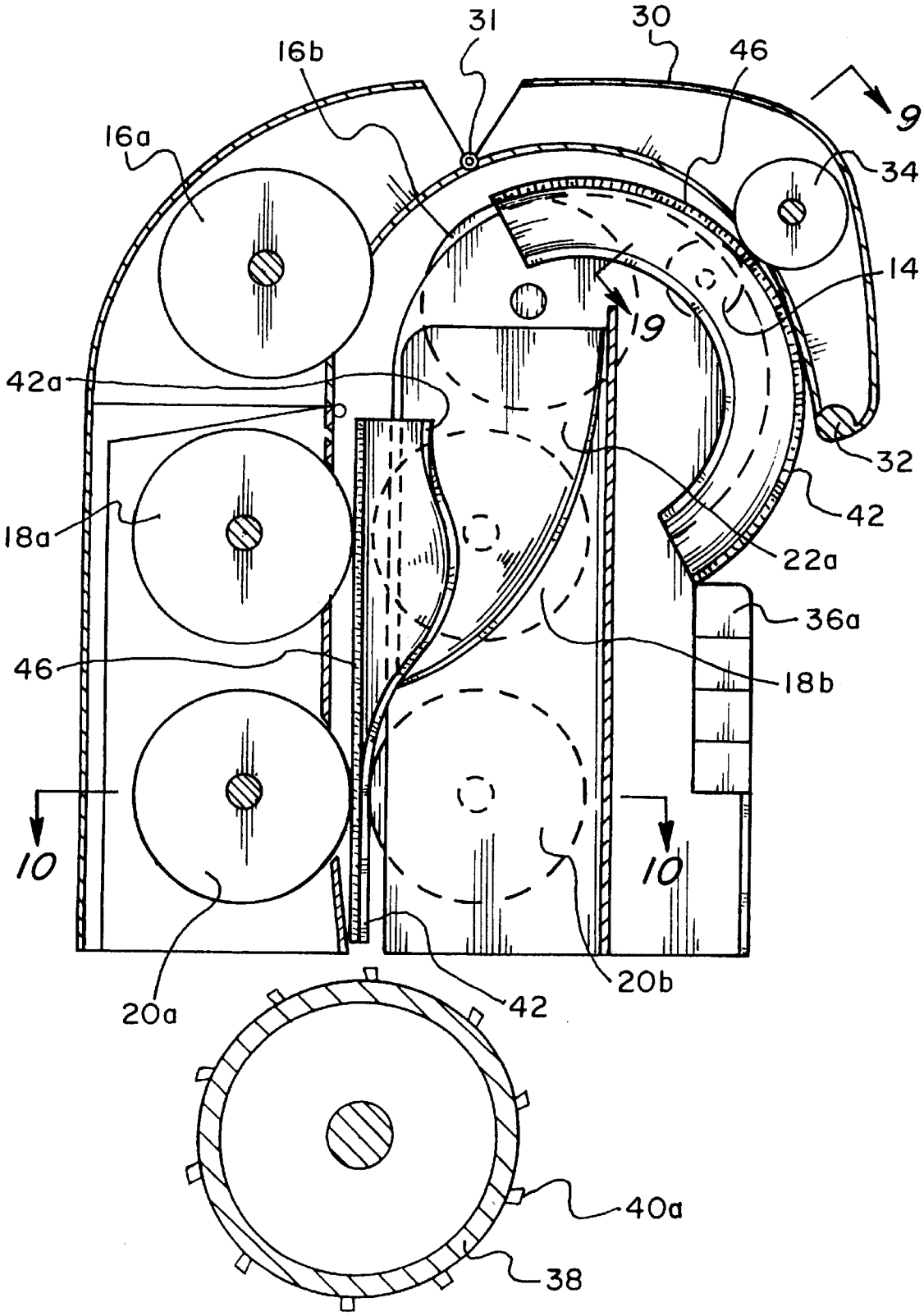
FIG. 6 is a cross-sectional view of the present invention taken along line 6—6 of FIG. 2 showing the path of a tire.

With the safety hood 30 in the open position the tire half 42 is placed within the housing 12 over pilot wheel 14 with the inside 44 of the tire 42 contacting the pilot wheel 14 and the side walls 42*a* and 42*b* of the tire overlying the side walls 15*a* and 15*b*. (See FIG. 9.) The steps or blocks 36*a*–36*d* may be used to position smaller tires within the housing. That is, a small tire half 42, for example, may rest against the topmost block 36*a* so that the tire 42 will be stabilized and properly aligned as it is positioned over the pilot wheel 14. (See FIG. 6.) A larger tire half, however, may not require all of the blocks. Blocks may be added or removed depending upon the size of the tire being fed into the machine.

Once the tire 42 is placed over the pilot wheel 14, the handle 32 is grasped and the safety hood 30 is brought down into the closed position. The tread portion 46 of the tire 42 now contacts the driven wheel 34 as the wheel is forced downwardly and the tire 42 lies within the nip between the wheels 14 and 34. (See FIG. 6.) A limit switch (not shown) is preferably automatically activated when the safety hood is moved down into its operative position and the motor is, thereby, started. The hood 30, therefore, acts as a safety mechanism in that the machine cannot be activated without the safety hood 30 being in a closed position. In this manner, the user's hands and fingers are not in the way and cannot be accidentally fed or pulled into the machine.

Figure 9:
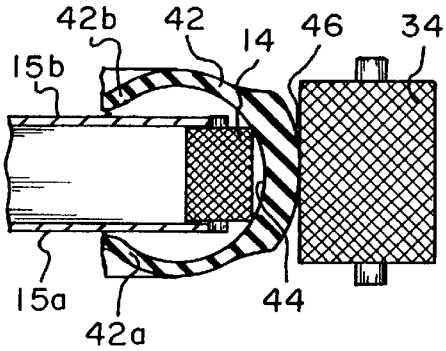
FIG. 9 is a partial cross-sectional view of the present invention taken along line 9—9 of FIG. 6.

Alternatively, it is possible to provide a manually operative switch to start the motor. In order to provide the same degree of safety, the shredding machine can be arranged so that the manually operated switch is inactive unless the safety hood is down or in its closed, operative position. In either case, with the tire 42 located between the driven wheel 34 and the pilot wheel 14 as seen in FIG. 9, the driven wheel 34 begins to rotate clockwise and the tire 42 is pulled into the machine.

Figure 7:
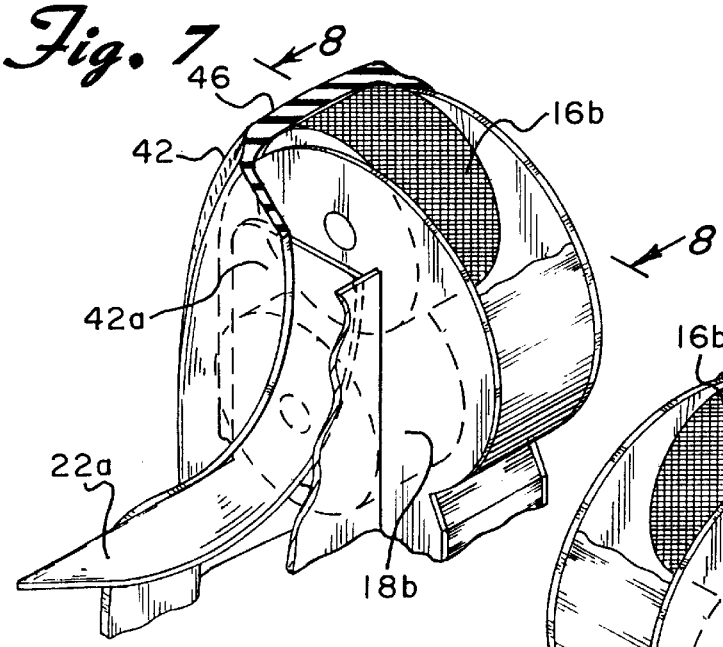
FIG. 7 is a partial perspective view illustrating how a tire is flared or flayed a wing of the present invention.
Figure 8:
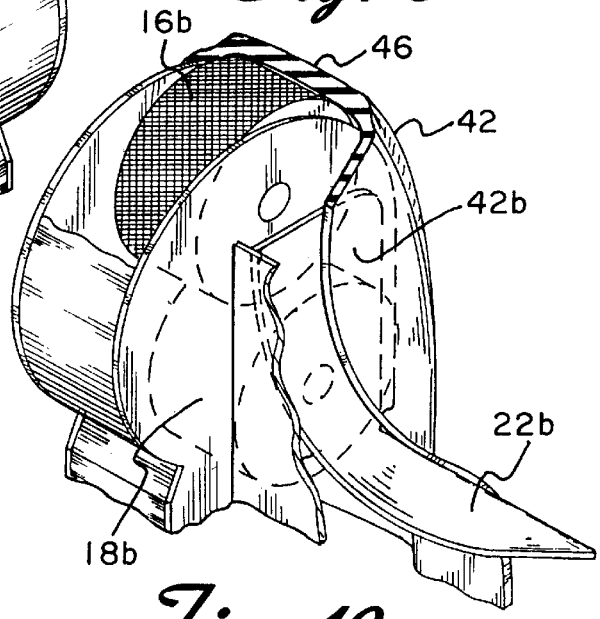
FIG. 8 is a cross-sectional view of the present invention taken along line 8—8 of FIG. 7.

Wheels 34 and 14 feed the tire 42 into the first set of grabber wheels 16*a* and 16*b* and onto the wings 22*a* and 22*b* which are located downstream of the intake rollers 14 and 34. The tire 42 is forced between the two wheels 16*a* and 16*b* and starts to flatten out. Wheels 16*a* and 16*b* force curved sidewall portions 42*a* and 42*b* of the tire 42 to contact the top portion 24 of the wing 22*a* which forces the tire to spread out or flare as seen in FIG. 7. (It should be noted that wing 22*a* will be used to illustrate, but, in fact, both wings 22*a* and 22*b* function in the same manner.) The tire 42 is forced to spread out even more as the curved sidewall portions 42*a* and 42*b* of the tire 42 encounter the second set of grabber wheels or rollers 18*a* and 18*b* and are forced over the broader portion 26 of the wing 22*a*. The tire 42 is forced between wheels 18*a* and 18*b* and over the cam surface 28 of wing 22*a*. That is, the shape of the wings forces the tire to be spread out or be splayed. In other words, the sidewall portions 42*a* and 42*b* are forced into substantially planar alignment with the tread portion 46 of the tire 42.

Figure 10:
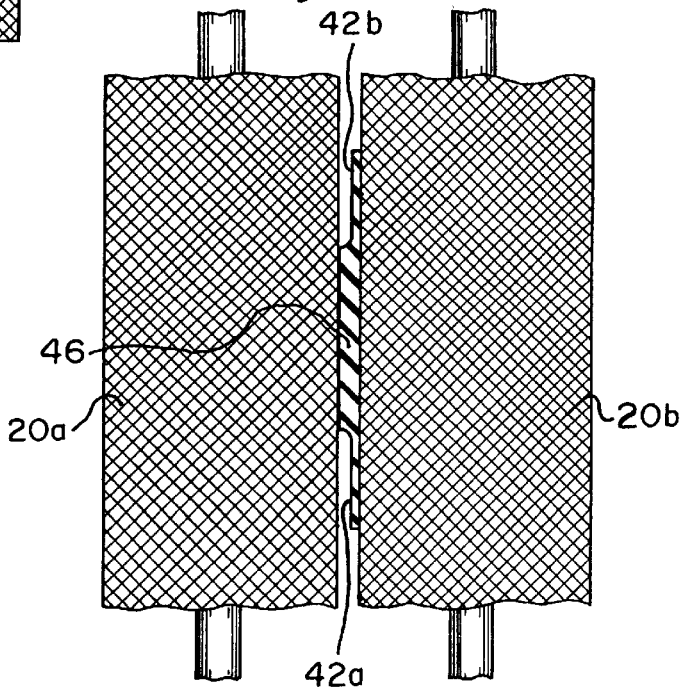
FIG. 10 is a partial cross-sectional view of the present invention taken along line 10—10 of FIG. 6.

The splayed tire 42 then reaches flattening rollers 20*a* and 20*b* located downstream of the wings 22*a* and 22*b*. The tire 42 proceeds between rollers 20*a* and 20*b* which flatten the tire 42 into a belt-like configuration and which maintain the tire 42 in this flattened condition. (See FIG. 10.) The blades 40*a*–40*j*, for example, of the rotating grinder wheel 38 then contact the leading edge of the flattened tire 42 as the tire 42 exits the housing 12. The blades 40*a*–40*j* shred the tire 42 and the shredded pieces may be collected into a storage container or fed onto a conveyor belt to be disposed of as desired. The shredded pieces each may be, for example, one to one and a half inches in size or substantially any desired size. As should be readily apparent to those skilled in the art, the size of the shredded pieces will determined by the speed of the machine rollers, the speed of the grinder wheel 38 and the number and arrangement of the blades 40*a*–40*j* on the grinder wheel.

Figure 3:
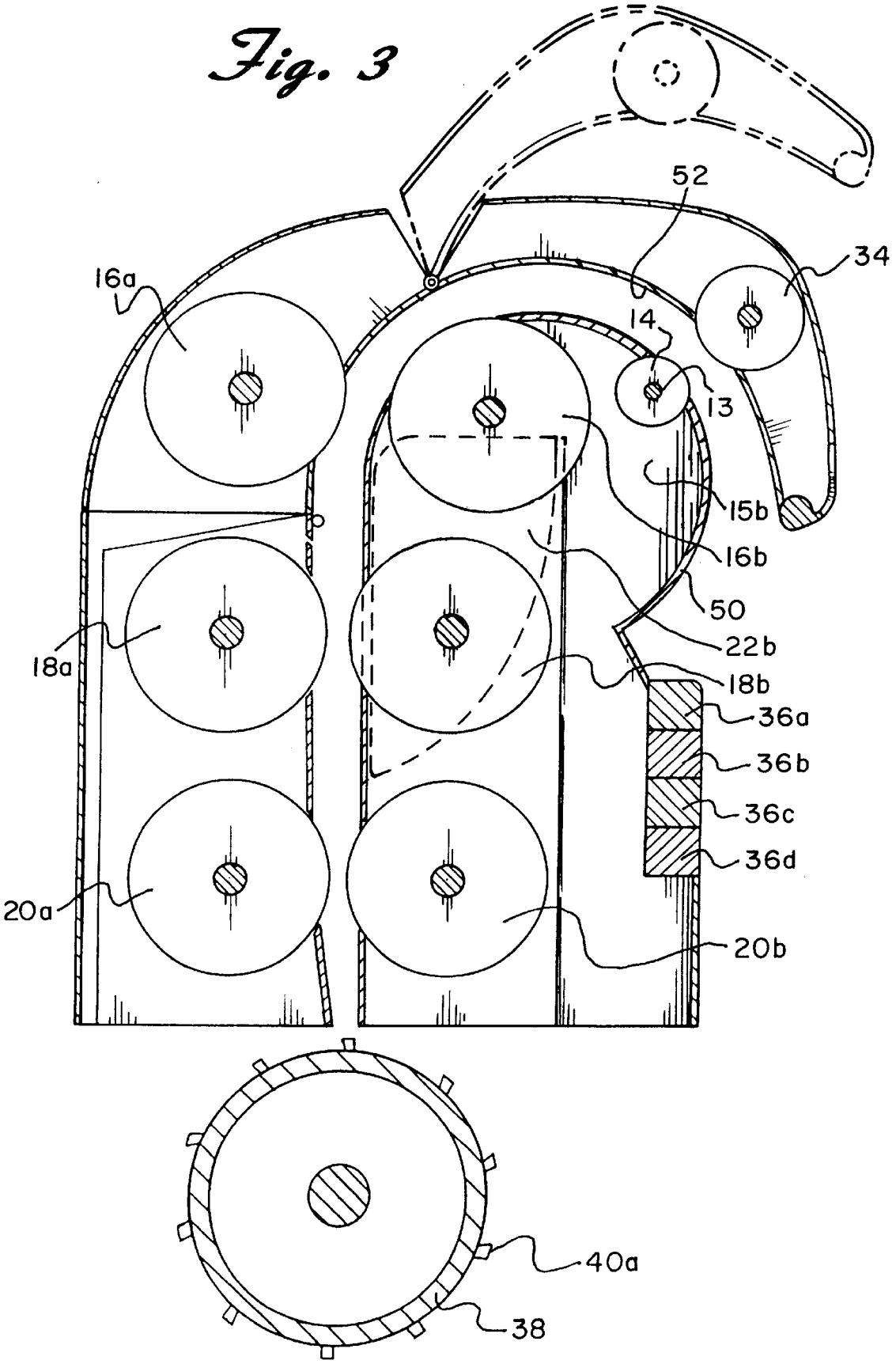
FIG. 3 is a cross-sectional view of the present invention taken along line 3—3 of FIG. 1.
Figure 4:
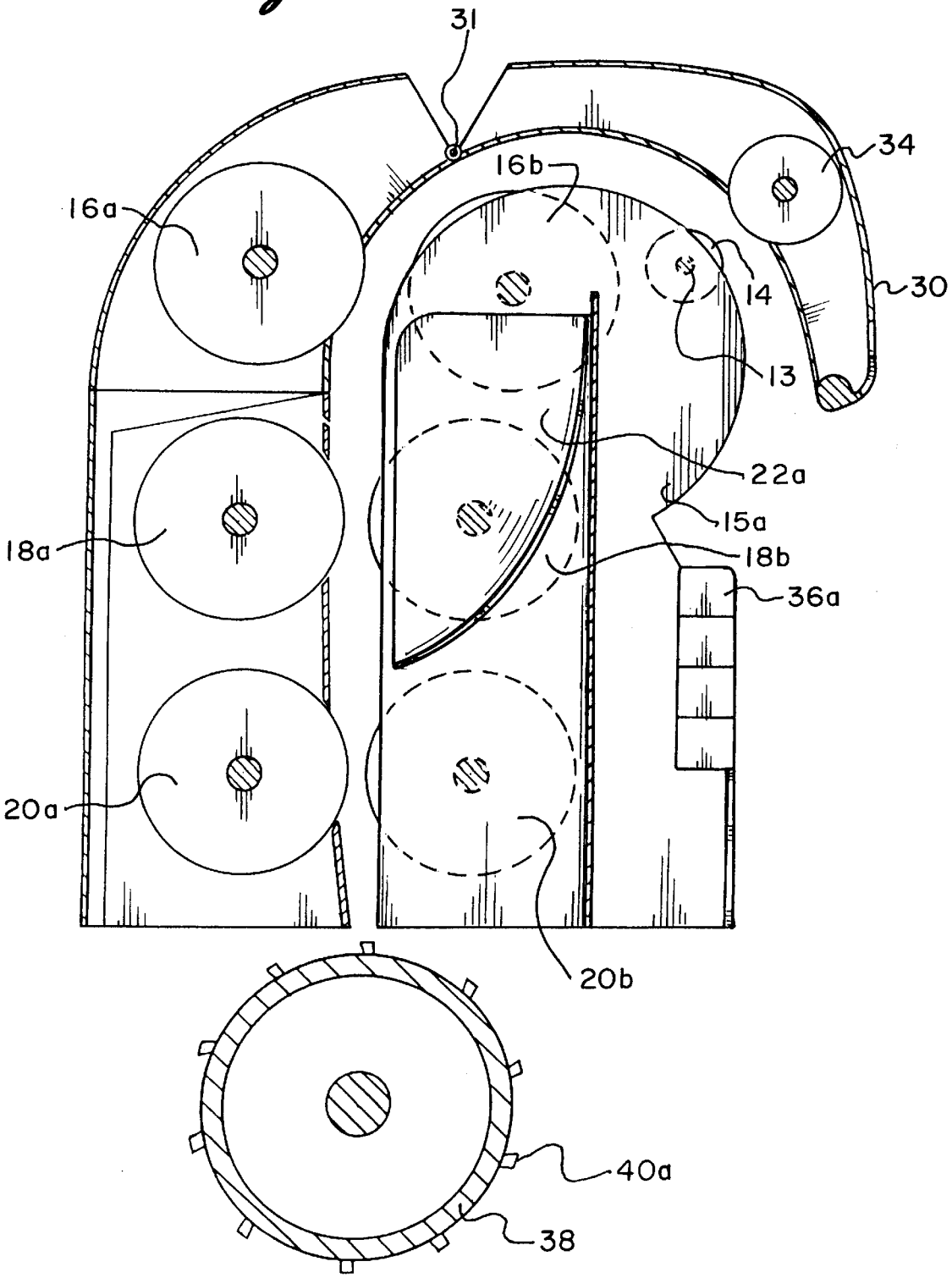
FIG. 4 is a cross-sectional view of the present invention taken along line 4—4 of FIG. 1.
Figure 5:
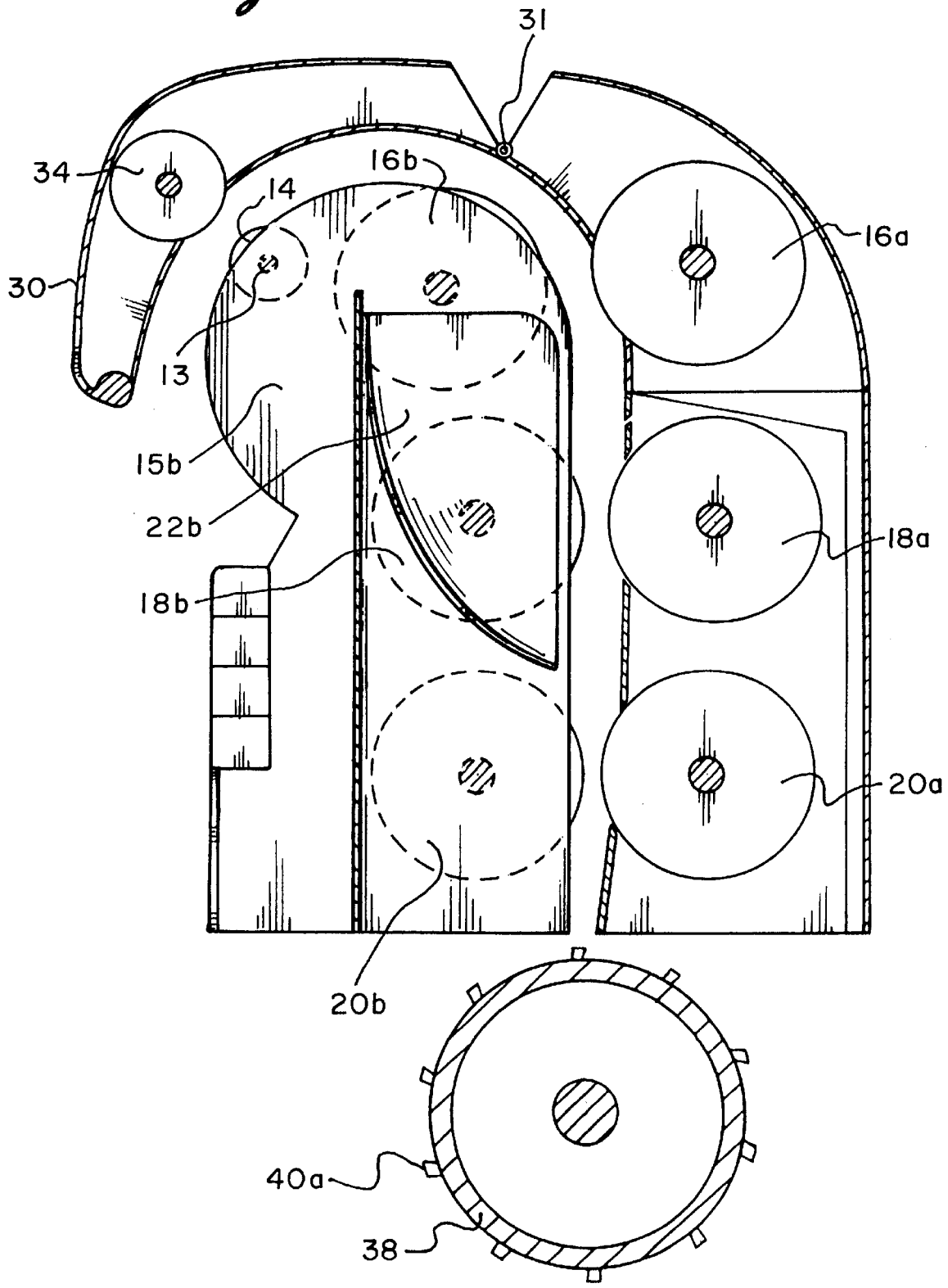
FIG. 5 is a cross-sectional view of the present invention taken along line 5—5 of FIG. 1.

Although it may appear from the drawings that the various wheels or rollers may be fully exposed thereby creating a risk of injury, the shredding machine 10 has been shown in this manner for illustration purposes only. In commercial use, it is anticipated that various covers would be employed to cover each roller or wheel exposing only that portion needed to contact the tire. FIGS. 1 and 3, for example, show cover 50 located between side walls 15*a* and 15*b* except where the operable segment of the wheel 14 is located. Similarly, the lower portion of the safety hood 30 includes a cover 52 and shown in FIG. 3. These covers not only serve to prevent injury but also help to guide the tire as it is moved through the machine. The majority of the covers are not shown as they would obscured to operable components of the shredding machine.

The present invention provides several advantages over shredding machines currently being used. For example, by having the various wheels or rollers arranged in a vertical orientation instead of horizontally, the present invention is compact and smaller than comparable shredding machines currently being used. Because of its smaller size, the present invention occupies less space. In fact, the present machine may be mounted between the cab and the fifth wheel of a truck towing a large trailer. Also, the present machine weighs between 2000 and 4000 pounds whereas comparable machines weigh between 14,000 and 88,000 pounds. Furthermore, the present machine requires less power to operate and may be driven hydraulically.

The present invention may be embodied in other specific forms without departing from the spirit or essential attributes thereof and accordingly, reference should be made to the appended claims rather than to the foregoing specification as indicating the scope of the invention.

I claim:

1. A tire shredding machine for shredding tires that have been cut into segments, the tire segments having a tread portion and curved sidewall portions, said machine comprising:

a housing including an inlet and an outlet;

a safety hood located adjacent said inlet and movable between an open position and a closed position;

a pair of intake rollers, said intake rollers including a first roller mounted in said housing and a second roller carried by said safety hood, said intake rollers cooperating to draw the tire segment into said machine when said the tire segment is placed over said first intake roller and said safety hood is moved into said closed position;

means located downstream of said intake rollers for splaying the sidewall portions of the tire segment into substantially planar alignment with the tread portion of the tire segment;

a pair of flattening rollers located downstream of said splaying means and adjacent said outlet, wherein said flattening rollers maintain the tire segment in a flattened condition; and grinding means located adjacent said outlet for grinding the tire segment as it exits said pair of flattening rollers.

2. The tire shredding machine of claim 1 wherein said intake rollers include an idle wheel and a driven wheel.

3. The tire shredding machine of claim 1 wherein said splaying means include curved walls over which the tire segment passes.

4. The tire shredding machine of claim 3 further including means for forcing the tire segment over said curved walls.

* * * * *